United States Patent [19]

Lipsker et al.

[11] Patent Number: 4,770,256

[45] Date of Patent: Sep. 13, 1988

[54] SOIL DRILLING

[76] Inventors: Yitshaq Lipsker, Ramath Hasharon; Mordechai Yuger, 24 Y.L. Baruch Street, Herzlia, both of Israel

[21] Appl. No.: 9,029

[22] Filed: Jan. 28, 1987

Related U.S. Application Data

[60] Division of Ser. No. 802,605, Nov. 25, 1985, abandoned, which is a continuation-in-part of Ser. No. 504,166, Jun. 14, 1983, abandoned.

[51] Int. Cl.[4] ..... E21B 7/20

[52] U.S. Cl. ..... 175/57; 175/171; 299/11; 405/146; 405/150

[58] Field of Search ..... 175/19, 57, 72, 99, 175/230, 263, 171; 405/142, 150, 237, 238, 271, 289, 146; 299/20, 21, 11

[56] References Cited

U.S. PATENT DOCUMENTS

| | | | |
|---|---|---|---|
| 1,751,607 | 3/1930 | Smith | 405/238 |
| 1,836,083 | 12/1931 | Miller | 405/238 |
| 2,167,500 | 7/1939 | Dornfeld et al. | 175/19 |
| 2,837,325 | 6/1958 | Biedess | 175/99 |
| 3,180,437 | 4/1965 | Kellner et al. | 175/94 |
| 3,215,214 | 11/1965 | Caro | 175/99 |
| 3,343,614 | 9/1967 | Parisien | 175/19 |
| 3,357,506 | 12/1967 | Bosredon | 175/99 |
| 3,559,412 | 2/1971 | Fuller | 405/237 |
| 3,614,160 | 10/1971 | Hosel et al. | 175/94 |
| 3,825,077 | 7/1974 | Jackson | 175/57 |
| 3,942,595 | 3/1976 | Sudnishnikov et al. | 175/99 |
| 4,124,985 | 11/1978 | Maimets | 405/150 |
| 4,154,311 | 5/1979 | Fischer et al. | 175/57 |
| 4,193,461 | 3/1980 | Lamberton et al. | 175/19 |
| 4,247,222 | 1/1981 | Schosek | 405/184 |
| 4,314,615 | 2/1982 | Sodder, Jr. et al. | 175/94 |
| 4,411,557 | 10/1983 | Booth | 405/238 |
| 4,547,106 | 10/1985 | Lipsker | 405/259 |

FOREIGN PATENT DOCUMENTS

| | | | |
|---|---|---|---|
| 111689 | 10/1940 | Australia | 199/21 |
| 870383 | 3/1953 | Fed. Rep. of Germany | 175/99 |
| 701891 | 1/1941 | Fed. Rep. of Germany | 405/237 |
| 1157162 | 11/1963 | Fed. Rep. of Germany | 175/19 |
| 462167 | 1/1914 | France | 405/237 |
| 1238773 | 7/1960 | France | 405/237 |
| 547766 | 11/1968 | France | 299/20 |
| 193621 | 11/1982 | Japan | 405/238 |
| 521381 | 9/1976 | U.S.S.R. | 175/19 |
| 759666 | 9/1980 | U.S.S.R. | 175/19 |
| 846749 | 7/1981 | U.S.S.R. | 405/289 |
| 1102682 | 2/1968 | United Kingdom | 405/237 |

*Primary Examiner*—Stephen J. Novosad
*Assistant Examiner*—Hoang C. Dang
*Attorney, Agent, or Firm*—Browdy and Neimark

[57] ABSTRACT

Soil drilling tools are provided with at least two sidewardly movable plate members adapted to exert pressure on the wall of a bore hole to prevent a cave in.

10 Claims, 2 Drawing Sheets

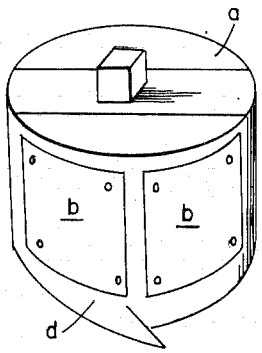
FIG. 1
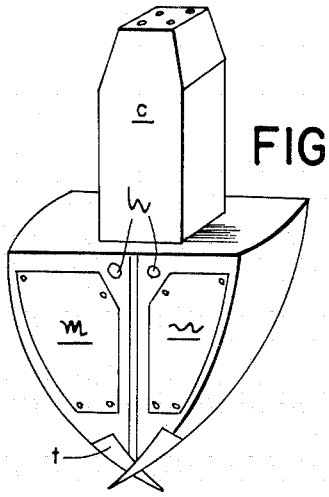
FIG. 2
FIG. 4
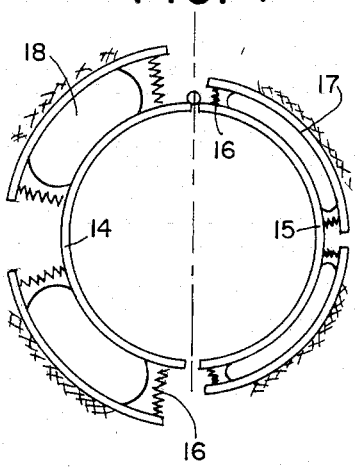
FIG. 5
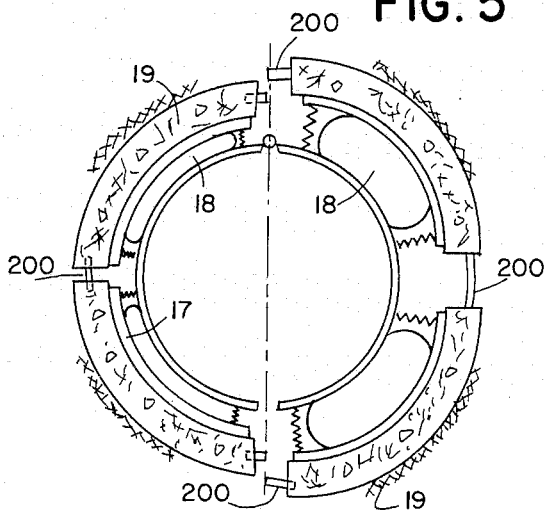
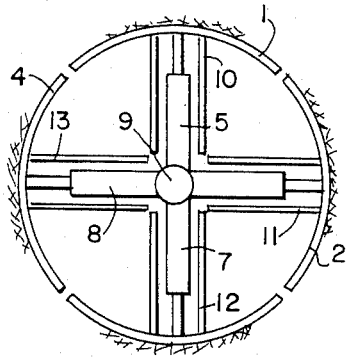
FIG. 3
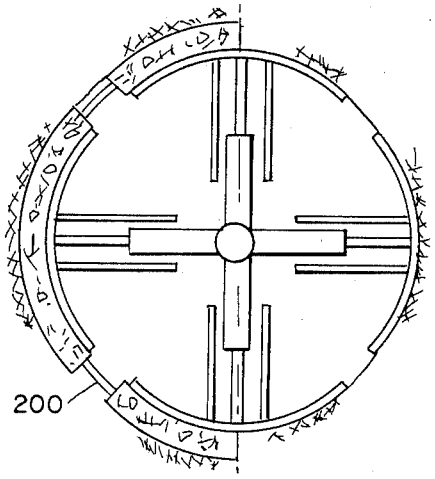
FIG. 6

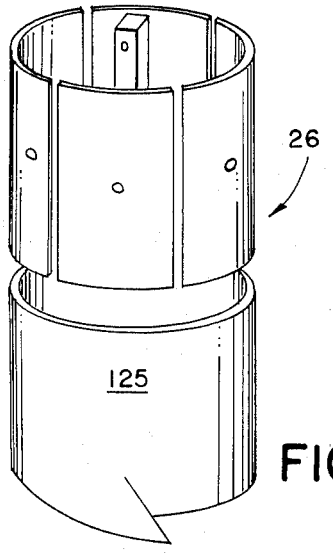
FIG. 9
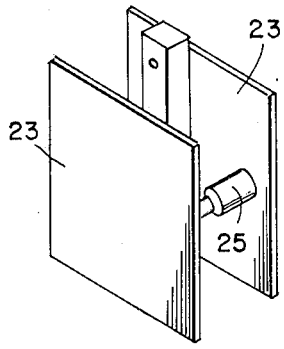
FIG. 8
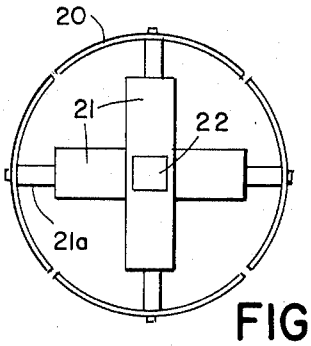
FIG. 10
FIG. 11
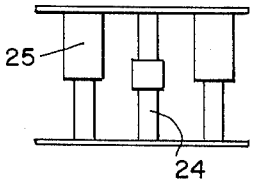
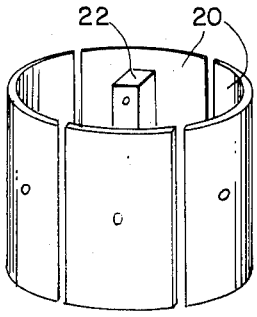
FIG. 7
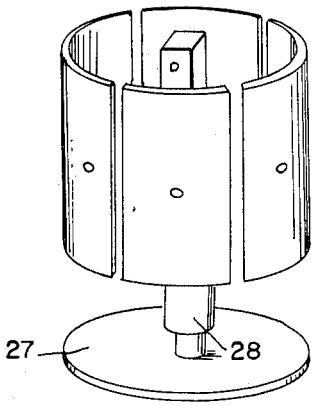
FIG. 12

SOIL DRILLING

This application is a division of application Ser. No. 802,605, filed Nov. 25, 1985, now abandoned, which is a continuation-in-part of application Ser. No. 504,166, filed June 14, 1983, now abandoned.

This invention relates to soil drills and excavating tools and more particularly to drills of the Auger Bucket Type and to digging grabs. The invention further relates to a method of producing bore shafts in the ground.

As is known, bore shafts of smaller or greater depth, both vertical and horizontal ones, as well as such extending obliquely to the soil surface, are made for various purposes, such as piling, tunnelling and many more. One of the problems encountered by those who work in this field is the caving in of a shaft, either while work is still in progress or whenever the drilling tool is withdrawn, either periodically during progress of work or after completion thereof. For that reason, i.e. in order to prevent a cave in, especially in cases of light and sandy soil, the walls of the shaft have to be safeguarded by lining, as is done e.g. in tunnelling operations or by introduction of mud as is conventionally practised. Obviously, such steps preventing cave in have to be performed after withdrawal of the respective tools, which means that at these times drillings stops, or work has to be slowed down considerably in the case of mud being introduced while drilling.

All this obviously lengthens the period of time required for the production of a bore and also considerably increases the cost of the work.

It is the main object of this invention to provide a device which performs simultaneously the actual drilling and the consolidation and stabilization of the soil forming the wall of the bore, thus accelerating the progress of the operation and reducing the cost thereof.

According to the invention there are provided tools positioned in a relatively fixed relationship along the bore hole axis relative to the digging means, (which may be of the bucket type or digging grabs) which comprise at least two plate shaped parts and means adapted to cause the said two parts to move away from one another and thus exert pressure onto the wall of the bore hole. The plate shaped parts are curved when used on a bucket type auger and plane if used on a grab.

The means for bringing about the said movement may be either mechanical, pneumatic or hydraulic.

According to an embodiment of the invention, the auger is of the split type, the bucket comprising two or more parts which are so connected that they can be moved apart and thus exert pressure on the wall of the bore shaft consolidating the latter and preventing a cave in.

According to another embodiment of the invention, an auger is enclosed by a number of curved plates which perform the consolidation of the bore hole wall.

In case of a grab, plane plates are provided at the opposite, flat siades of the grab.

In an advantageous embodiment of the invention, as applied to an auger device, the said curved plates are connected with the auger itself by a number of tension springs, which, after actuation of the means pressing the plates towards the wall of the bore hole and after release of the pressure, return the plates to their normal position close to the cylindrical surface of the auger.

According to yet another embodiment ring shaped members which are slipped on the auger, and which rings comprise at least two parts and are pressed by the crosswise expansion of the auger onto the wall of the bore hole to form a lining thereof. In the latter case the auger is periodically withdrawn from the bore hole and fresh rings are placed thereof, as the work proceeds.

In the case of tunnelling jobs, the auger need not always be withdrawn, instead the rings are fed onto the auger from the rear, while soil is removed therefrom by a conveyor.

By the means referred to, the bore hole wall is consolidated and cave in may be prevented, but, in addition, and in certain cases most importantly, the bore hole could be widened, which means that relatively wide bore holes could be produced by smaller and weaker rigs as heretofore, i.e. by drilling equipment which conventionally could produce only bores of smaller diameter.

Bore holes produced with the aid of the new device may extend strictly vertically or horizontally or obliquely.

In certain cases, where there is no immediate likelihood of cave in but such occurrence could be expected at some later time, it could be preferable or advantageous to first drill the bore hole and only after termination of that step, or whenever a certain depth has been reached, to consolidate the wall of the hole and possibly widen it.

Tools for dealing with such a contingency may be used in combination with the tools which are the main subject of this invention.

There is provided an auxiliary device constituted by at least two inter-connected plates enclosing a space between them in which space are positioned means for moving the plates apart, such means being actuated hydraulically or pneumatically or mechanically.

In a practical embodiment, the new auxiliary device comprises a number of slightly curved plates which together define a cylindrical body within which a number of piston-in-cylinder means are positioned for moving the plates apart from one another.

Alternatively, the new device may be constituted by at least two plane plates which are positioned at a distance from one another, the said piston-in-cylinder means being accommodated within the space between the plates.

The bore holes so produced may be part of different kinds of work but most adantageously will serve in piling work. It is possible to make certain portions of a bore hole, say, the lower region thereof, wider than the rest, and cast the pile in that wider portion. Alternatively, and depending on the kind of soil in a particular job, the bore hole could be tapering downwardly, thus making it possible to produce tapering piles or like formations. Moreover, consolidation of the bore hole wall improves the soil parameters and increases the bearing capacity of the piles.

The invention will now be described in detail in connection with the attached drawings which illustrate, by way of example, tools incorporating the improvement of the present invention.

In the drawings, FIGS. 1 and 2 are schematical, perspective views of a bucket auger and of a digging grab respectively.

FIGS. 3–6 are cross sectional, horizontal, sections of different embodiments of the invention, applied to bucket type augers.

The auxiliary devices referred to are shown in FIGS. 7–12.

FIG. 7 shows the new device in cylindrical shape, while

FIG. 8 is the device constituted by two plane plates.

FIG. 9 shows the new device mounted on top of an auger.

FIG. 10 is a top view of the devices shown in FIGS. 1 and 3.

FIG. 11 is a top view of the device shown in FIG. 8, and

FIG. 12 is a device similar to that of FIG. 7 but equipped with an additional tool.

FIGS. 13–15 show a variety of bore hole profiles which may be produced according to the method of the present invention.

For a better understanding of the gist of this invention, reference is first made to the conventional tools shown in FIGS. 1 and 2.

The bucket type auger of FIG. 1 is of the plate enclosed kind. It comprises a body parts a and lateral closing plates b. The actual drilling is performed by two or more cutters d at the bottom of the bucket. As drilling proceeds removed soil rises in the bucket which has to be lifted periodically to the surface for emptying it.

The drilling grab shown in FIG. 2 comprises two shovels m and n which depend from a box shaped body C. The two shovels m and n swing about their hinges h. They are usually provided with cutters or teeth t. The shovels m and n open to opposite directions and when closing again gather ("grab") a portion of the soil into which the tool digs. The digging grab is also lifted to the surface for emptying.

Turning now to FIG. 3, there is shown in a cross sectional view a bucket type auger comprising four arch shaped segments 1, 2, 3, 4 which are interconnected by four crosswise grouped hydraulic cylinders 5, 6, 7, 8 extending from a central shaft 9. The said cylinders are positioned within guide rails 10, 11, 12, 13 which extend from the inner face of segments 1, 2, 3, 4.

This auger is worked in the customary way, is periodically lifted to the surface for emptying and cleaning. In order to consolidate the wall of the bore hole the hydraulic cylinders are operated via a conduit supplying pressure fluid with the effect of moving the segments 1, 2, 3, 4 away from the centre and exerting lateral pressure on the bore hole wall.

The auger shown schematically in FIG. 4 is of conventional build and comprises two halves 14, 15.

To each of the semi circular halves 14, 15 are connected via springs 16, crescent shaped plates 17. Interposed between the auger halves 14, 15 and the respective plate are inflatable bodies 18. This auger is also worked in the conventional manner; whenever required the inflatable bodies 18 are put under pressure and inflated, thereby pressing the plates onto the wall of the bore hole and consolidating the soil. When pressure is released, the bodies 18 become deflated and the plates 17 are retracted onto the auger.

In FIG. 4 the right hand part of the auger is shown in position of drilling, i.e. with plates 18 close to the auger. The left hand part of FIG. 4 shows the plates 17 being pressed onto the wall of the bore hole by means of the inflated bodies 18.

According to FIG. 5, the plates 17 carry ring segments, which, in the manner described in connection with FIG. 4, are pressed into the soil of the bore hole wall and remain there, lining the latter.

Ring segments 19 are interconnected by sliding portions 200 which are slidable within receiving spaces between the inner and outer surfaces of the ring segments 19.

The construction of FIG. 6 also uses the ring segments, but in this case they are carried on segments forming the auger proper, as described in connection with FIG. 3.

The use of equivalent plates on grabs, according to FIG. 2 is obvious and needs no detailed description. Suffice it to say that plane plates are connected to and carried on the plane sides of the grab in the one of the manners described with reference to FIGS. 3–6.

Turning now to FIG. 7, the new device comprises four curved plates 20, which are interconnected by a cross of four piston-in-cylinder tools 21 (see FIG. 10), which are held on a square profiled bar 22 positioned at the centre of the cylinder formed by the plates 20. The cylinders of the tools 21 are affixed to the bar 22 while the piston rods 21a are attached to plates 21. Similarly, the plates 23 shown in FIG. 8 are inter-connected by a telescoping connection 24, while two piston-in-cylinder tools 25 extend between the two plates.

The devices of FIG. 7, FIG. 8 or FIG. 11 are passed into bore hole. The piston-in-cylinder tools 21 or 25 are actuated by fluid pressure supplied from the top through a conduit entering the respective cylinder. Due to this, the pistons move outwardly of the cylinders, so that the plates 20 or 23 are pressed against the wall of the bore hole and consolidate the ground. These devices of FIGS. 7 and 8 are employed in those cases where the bore hole has reached a certain depth and the auger, or grab—whatever had been used—have been withdrawn.

According to FIG. 9 the new device is mounted on top of an auger of bucket type, designated by the numeral 25. The function of the auger need not be described, but whenever desired, drilling may be stopped temporarily and the new device—here designated as a whole by the numeral 26—may be actuated. It then functions in the manner described.

It goes without saying that a device as shown in FIG. 8 may be mounted on the digging tool, possibly on top of a grab.

Turning finally to FIG. 12, there is shown a device as that of FIG. 7 but including a pressure plate 27 which is actuated by a piston-in-cylinder tool 28 which latter is positioned coaxially with the device as a whole. This latter arrangement serves for compacting the bottom of a bore hole whenever desired. Usually the pressure plate 27 will be actuated after plates 20 are pressed against the bore hole walls.

As has been stated, the main purpose, or one of the purposes of the new devices is compacting and consolidating the soil forming the wall and/or bottom of a bore hole. However, the same devices, used independently of a digging tool, can also serve as a load test to indicate the nature, i.e. density and compactness of soil strata by registering the resistance of the soil at certain locations to the movement of the pistons towards the ground.

So, the device of FIG. 7 may be used only for compacting the soil or only for measuring its resistance to pressure. The device of FIG. 9 can be used for digging, temporarily stopping the digging and consolidating, compacting and/or measuring density or compactness of different strata, as the work progresses.

All instruments when serving in both functions as a consolidating device or as a load test device can be equipped with conventional measuring devices to accurately indicate the amount of expansion of the device versus the pressure applied.

Portions (a), (b) and (c) are widened by deploying the soil consolidation tool described above so that the plates thereof press outwardly against the corresponding portions (a), (b) and (c), respectively.

The vertically-stacked widened portions (a), (b), (c) of FIG. 13 may be located anywhere along the bore hole, each widened portion being connected to the next by a non-widened portion d. Any number of widened portions greater than two may be employed.

FIG. 14 shows an "under-rimmed" bore hole profile. Bore hole profile 110 is produced similarly to bore hole profile 100 except that the widened portions e, f, g are made adjacent each other and increase in width as the bore hole depth increases and are widest at the bottom of the bore hole 102'. As in the bore hole of FIG. 13, any number of widened sections greater than 2 may be used.

FIG. 15 shows a tapered bore hole profile 112 produced similarly to bore hole profiles 100 and 110. The widened portions h, i, j and k are adjacent and are widest at the top of bore hole 102", decreasing in width as the depth along bore hole 102" increases. The dashed lines represent the width along bore hole 102" as initially drilled.

We claim:

1. A soil drilling tool for consolidating and lining the walls of a bore hole so as to prevent a cave-in of said bore hole, comprising at least two plate-shaped parts and an inflatable balloon means for causing said two plate-shaped parts to deploy and move away from one another and thus exert pressure onto the wall of said bore hole in such a manner as to consolidate layers of soil forming said bore hole to a substantial degree when said balloon means is inflated;

said plate-shaped parts being biased to move toward each other by a spring means, each of said plate-shaped parts being attached to an outer periphery of an auger by said spring means, said spring means also biasing said plates to move toward said auger, said balloon means comprising balloons positioned between each plate and said auger;

said at least two plate-shaped parts jointly carrying thereon a radially expandable ring which surrounds said auger, extending around outer surfaces of said plate-shaped parts and having an inner surface of a shape conforming to said outer surfaces of said plate-shaped parts;

said ring comprising a plurality of ring segments interconnected by sliding portions which are slidable into a receiving space between outer and inner surfaces of at least one ring segment;

whereby, when said ring is expanded into said wall of said bore hole, said ring segments are forced into said layers of soil, and together with said sliding portions, form a lining within said bore hole.

2. The tool of claim 1, wherein said auger is circular and said plate-shaped parts are curvelinear so as to correspond to the shape of said outer periphery of said auger when said plate-shaped parts are in a non-deployed condition.

3. The tool of claim 2, wherein each of said spring means comprises, for each plate-shaped part, a pair of springs, said pair of springs being attached to adjacent opposing lateral ends of said plate-shaped part and extending from a surface of said plate-shaped part facing said auger to said outer periphery of said auger, said balloon means being positioned laterally between said pair of opposing springs.

4. A method of drilling bore holes and consolidating and lining the bore hole wall, comprising the steps of:

(a) making a bore hole in a portion of ground to a depth selected according to the soil quality, type and the structure to be erected, said bore hole having side walls and defining vertically stacked portions thereof;

(b) inserting into said bore hole a tool comprising at least two plate-shaped parts and an inflatable balloon means for causing said two plate-shaped parts to deploy and move away from one another and thus exert pressure onto the wall of said bore hole in such a manner as to consolidate layers of soil forming said bore hole to a substantial degree when said balloon means is inflated, said plate-shaped parts being biased to move toward each other by a spring means, each of said plate-shaped parts being attached to an outer periphery of an auger by said spring means, said spring means also biasing said plates to move toward said auger, and said balloon means comprises balloons positioned between each plate and said auger;

(c) applying pressure against the side walls along a first vertically stacked portion of said bore hole by inflating said balloon means so as to widen the diameter of said first vertically stacked portion of said bore hole;

(d) deflating said balloon means; and, prior to step (c);

placing a radially expandable ring upon said plate-shaped parts so that said expandable ring surrounds said auger and extends around outer surfaces of said plate-shaped parts, said ring having an inner surface of a shape conforming to said outer surfaces of said plate-shaped parts, said ring comprising a plurality of ring segments interconnected by sliding portions which are slidable into a receiving space between outer and inner surfaces of at least one ring segment, whereby, when said ring is expanded into said wall of said bore hole, said ring segments are forced into said layers of soil, and together with said sliding portions form a lining within said bore hole;

whereby after deflating said balloons according to step (d), said plate-shaped parts have retracted and said ring segments, together with said sliding portions, remain fixed in said wall of said bore hole as said lining.

5. The method of claim 4, wherein said auger is circular and said plate-shaped parts are curvelinear so as to correspond to the shape of said outer periphery of said auger when said plate-shaped parts are in a non-deployed condition.

6. The method of claim 4, wherein each of said spring means comprises, for each plate-shaped part, a pair of springs, said pair of springs being attached to adjacent opposing lateral ends of said plate-shaped part and extending from a surface of said plate-shaped part facing said auger to said outer periphery of said auger, said balloon means being positioned laterally between said pair of opposing springs.

7. The method of claim 4, further comprising the steps of:

(e) applying pressure against the side walls along a second vertically stacked portion of said bore hole by inflating said balloon means, to widen the diameter of said second vertically stacked portion of said bore hole, said first and second vertically stacked portions being connected by a third, unwidened, vertically stacked portion, to produce a first and second widened portion connected by an unwidened vertically stacked position.

8. The method of claim 4, further comprising the steps of:

(e) axially moving said tool;

(f) applying pressure against the side walls along a second vertically stacked portion of said bore hole by inflating said balloon means to widen the diameter of said second vertically stacked portion to a width greater than that of said first vertically stacked portion, said second vertically stacked portion being adjacent to, and at a greater depth than, said first vertically stacked portion.

9. A soil drilling tool for consolidating and lining the walls of a bore hole so as to prevent a cave-in of said bore hole, comprising at least two plate-shaped parts and an expandable means for causing said two plate-shaped parts to deploy and move away from one another and thus exert pressure onto the wall of said bore hole in such a manner as to consolidate layers of soil forming said bore hole to a substantial degree when said expandable means is expanded, said plate-shaped parts being biased to move toward each other by a spring means;

each of said plate-shaped parts being attached to an outer periphery of an auger by said spring means, said spring means also biasing said plates to move toward said auger, said expandable means being positioned between each plate and said auger;

said at least two plate-shaped parts jointly carrying thereon a radially expandable ring which surrounds said auger, extending around outer surfaces of said plate-shaped parts and having an inner surface of a shape conforming to said outer surfaces of said plate-shaped parts, said ring comprising a plurality of ring segments interconnected by sliding portions which are slidable into a receiving space between outer and inner surfaces of at least one ring segment;

whereby, when said ring is expanded into said wall of said bore hole, said ring segments are forced into said layers of soil, and together with said sliding portions, form a lining within said bore hole.

10. A method of drilling bore holes and consolidating and lining the bore hole wall, comprising the steps of:

(a) making a bore hole in a portion of ground to a depth selected according to the soil quality, type and the structure to be erected, said bore hole having side walls and defining vertically stacked portions thereof;

(b) inserting into said bore hole a tool comprising at least two plate-shaped parts and an expandable means for causing said two plate-shaped parts to deploy and move away from one another and thus exert pressure onto the wall of said bore hole in such a manner as to consolidate layers of soil forming said bore hole to a substantial degree when said expandable means is expanded;

(c) applying pressure against the side walls along a first vertically stacked portion of said bore hole by expanding the expandable means so as to widen the diameter of said first vertically stacked portion of said bore hole, each of said plate-shaped parts being attached to an outer periphery of an auger by a spring means, said expandable means being positioned between each plate-shaped part and said auger, and biasing said plate-shaped parts toward each other and said auger by said spring means;

(d) retracting said expandable means; and, prior to step (c), placing a radially expandable ring upon said plate-shaped parts so that said expandable ring surrounds said auger and extends around outer surfaces of said plate-shaped parts, said ring having an inner surface of a shape conforming to said outer surfaces of said plate-shaped parts, said ring comprising a plurality of ring segments interconnected by sliding portions which are slidable into a receiving space between outer and inner surfaces of at least one ring segment;

whereby, when said ring is expanded into said wall of said bore hole, said ring segments are forced into said layers of soil, and together with said sliding portions form a lining within said bore hole and, once said expandable means is retracted according to step (d), said plate-shaped parts retract and said ring segments, together with said sliding portions, remain fixed in said wall of said bore hole as said lining.

* * * * *